US008534940B2

(12) United States Patent
Nagata

(10) Patent No.: US 8,534,940 B2
(45) Date of Patent: Sep. 17, 2013

(54) PRINTER WITH MOVEABLE FIRST AND SECOND PRINT HEAD UNITS

(75) Inventor: Norio Nagata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 13/032,707

(22) Filed: Feb. 23, 2011

(65) Prior Publication Data

US 2011/0236109 A1 Sep. 29, 2011

(30) Foreign Application Priority Data

Mar. 24, 2010 (JP) ..... 2010-067509

(51) Int. Cl.
*B41J 3/54* (2006.01)

(52) U.S. Cl.
USPC ..... 400/149; 400/605; 400/607; 400/607.2; 400/693

(58) Field of Classification Search
USPC ..... 400/149, 693, 607.2, 607, 605
See application file for complete search history.

(56) References Cited

U.S. PATENT DOCUMENTS

| | | | | |
|---|---|---|---|---|
| 6,899,479 | B2 * | 5/2005 | Hayashi et al. | 400/621 |
| 6,986,464 | B2 | 1/2006 | Takiguchi et al. | |
| 8,139,093 | B2 * | 3/2012 | Koyabu et al. | 347/197 |
| 2008/0003040 | A1 * | 1/2008 | Sekino et al. | 400/188 |
| 2010/0060705 | A1 | 3/2010 | Masuda | |

FOREIGN PATENT DOCUMENTS

| | | | |
|---|---|---|---|
| CN | 101544129 | | 9/2009 |
| EP | 1520699 | A2 | 4/2005 |
| JP | 2000-043339 | | 2/2000 |
| JP | 2000-280576 | | 10/2000 |
| JP | 2005329563 | A * | 12/2005 |
| JP | 2010-020809 | | 1/2010 |

* cited by examiner

*Primary Examiner* — Daniel J Colilla

(57) ABSTRACT

A printer has a platen gap adjustment mechanism that can hold the platen gaps of two print heads substantially constant. A check processing device has a front print head unit on which are disposed a front print head, a first media transportation roller, and a back platen; a platen lever unit on which a second media transportation roller and front platen are disposed, and which can move toward and away from the first media transportation roller; a lever tension spring that urges the platen lever unit toward the first media transportation roller, and presses the second media transportation roller to the first media transportation roller; a back print head unit on which a back print head is disposed, and which can move toward and away from the first media transportation roller; and an unit tension spring that presses the back print head unit to the platen lever unit.

6 Claims, 5 Drawing Sheets

PRINTER WITH MOVEABLE FIRST AND SECOND PRINT HEAD UNITS

CROSS-REFERENCE TO RELATED APPLICATION(S)

The entire disclosure of Japanese Patent Application No. 2010-067509, filed on Mar. 24, 2010, is expressly incorporated by reference herein.

BACKGROUND

1. Technical Field

The present invention relates to a printer that has multiple print head sets for printing on both sides of checks or other recording media, and relates more particularly to a printer having a mechanism that can suitably set the platen gap for each print head assembly.

2. Related Art

A printer having a magnetic head for reading magnetic ink characters printed on checks, and two print head assemblies for printing on the front and back sides of checks is described as a media processing device in Japanese Unexamined Patent Appl. Pub. JP-A-2000-43339 and as a hybrid processing device in Japanese Unexamined Patent Appl. Pub. JP-A-2010-20809.

The front print head and back print head that are used to respectively print on the front and back sides of checks or other recording media are mounted on respective different frame members located on opposite sides of the recording medium transportation path. The platen that defines the printing position of the front print head is mounted on a frame member on the same side as the back print head, and the platen for the back print head is similarly mounted on the frame member on the same side as the front print head.

The platen gap of both print heads is typically narrow at 0.5 mm or less, and precisely disposing the two print heads and platens mounted on different frame members so that such a precise, narrow gap can be achieved is not as simple as when there is only a single print head and platen. More particularly, an external force that displaces both frame members can easily change both platen gaps, and adjusting the platen gaps is more difficult than when there is only one platen gap to be adjusted.

In addition, when the gap between the print head and platen is constant and media of different thicknesses are conveyed, the gap between the print head and the printing surface of the recording medium changes, and problems such as a drop in print quality can result. A problem with the related art is that adjusting the platen gap of both print heads according to the thickness of the recording medium is not possible.

SUMMARY

A printer according to the present invention has a platen gap adjustment mechanism that can maintain a constant platen gap at plural locations.

A first aspect of the invention is a printer comprising a first print head unit on which a first print head, a first media transportation roller, and a second platen are disposed; a second print head unit configured to move in a direction toward and away from the first media transportation roller, and on which are disposed a first platen at a position opposing the first print head, a second media transportation roller at a position where it can contact the first media transportation roller, and a second print head at a position opposing the second platen; and an urging member that urges the second print head unit toward the first media transportation roller and presses the second media transportation roller to the first media transportation roller.

Because the second print head unit can move, and the second media transportation roller mounted on the second print head unit is pressed by an urging member to a first media transportation roller disposed on a stationary first print head unit in this aspect of the invention, the relative positions of the two units are determined by the first and second media transportation rollers. The platen gaps of the first and second print heads are also held constant even when an external force displaces the units because contact between the first media transportation roller and second media transportation roller is held by the urging force of the urging member and the relative position of both units is held constant.

In addition, the gap between the first media transportation roller and second media transportation roller changes according to the thickness of the recording medium conveyed therebetween. As a result, the relative positions of the first print head unit and second print head unit determined by contact between these rollers change. The gap between the first print head on the first print head unit side and the first platen on the second print head unit side therefore changes as the thickness of the conveyed recording medium changes. The gap between the second print head on the second print head unit side and the second platen on the first print head unit side changes similarly. Because the platen gaps change according to the thickness of the conveyed recording medium, the distance between the print head units and the recording medium can be held to a constant size or greater.

In another aspect of the invention, the second media transportation roller and second platen can be disposed to a member separate from the second print head unit, and the first print head unit and second print head unit can be positioned by means of the member.

A printer according to this aspect of the invention comprises a first print head unit on which a first print head, a first media transportation roller, and a second platen are disposed; a moving member configured to move in a direction toward and away from the first media transportation roller, and on which are disposed a second media transportation roller at a position where it can contact the first media transportation roller, and a first platen at a position opposing the first print head; a first urging member that urges the moving member toward the first media transportation roller, and presses the second media transportation roller to the first media transportation roller; a second print head unit that can move in a direction toward and away from the first media transportation roller, and on which a second print head is disposed at a position opposing the second platen; and a second urging member that urges the second print head unit toward the first media transportation roller and presses the second print head unit to the moving member.

In this aspect of the invention the second media transportation roller disposed to the moving member is pressed by the first urging member to the first media transportation roller disposed to the first print head unit. Contact between the first media transportation roller and second media transportation roller determines the position of the first print head unit relative to the moving member, determines the position of the first print head disposed to the first print head unit relative to the first platen disposed to the moving member, and determines the platen gap of the first print head.

The second print head unit is pressed by the second urging member to the moving member positioned to the first print head unit, and the relative positions thereof are determined by contact between the moving member and the second print head unit. The relative positions of the first print head unit and second print head unit, the position of the second print head disposed to the second print head unit relative to the second platen disposed to the first print head unit, and the platen gap of the second print head, are thus determined by means of the intervening moving member.

The platen gap on the first print head side is thus adjusted between the first print head unit and the moving member, and the platen gap on the second print head side is adjusted between the first print head unit and second print head unit. The platen gaps can therefore be adjusted more easily using three members than when the first print head unit and second print head unit are used to adjust the platen gaps therebetween.

Furthermore, when the first print head unit, moving member, or second print head unit is displaced by external force, for example, the other two also move and are displaced accordingly. For example, if the first print head unit is displaced, the moving member follows the movement of the first print head unit, and the second print head unit moves according to the displacement of the moving member. The relative positions between the three components are therefore always held constant, and the platen gap determined by the first print head and the first platen, and the platen gap determined by the second print head and the second platen, are held constant.

The first print head unit and moving member are positioned relative to each other by contact between the first media transportation roller and second media transportation roller. The gap between these rollers changes according to the thickness of the conveyed recording medium. As a result, the position of the moving member relative to the first print head unit that is determined by contact between these rollers changes, and the position of the second print head unit determined by the moving member also changes. The gap between the first print head on the first print head unit side and the first platen on the moving member side therefore changes, and the gap between the second print head on the second print head unit side and the second platen on the first print head unit side changes, according to the thickness of the conveyed recording medium. Because the platen gap thus increases according to the thickness of the conveyed recording medium, the distance between the print head units and the recording medium can be held to a specific value or greater.

In another aspect of the invention, a pivot member that can rotate on a pivot point can be used as the moving member, and a tension spring connected between the pivot member and the second print head unit can be used as the first urging member. By suitably setting the positions where the tension spring is mounted and the shape of the pivot member, the moving member and second print head unit can be held pressed together by the force of the tension spring, and play therebetween can be suppressed.

Further preferably in another aspect of the invention, when seen along the transportation direction of the recording medium passing the nip point of the first media transportation roller and second media transportation roller, one of the first print head and second print head is positioned on the upstream side in the transportation direction and the other is positioned on the downstream side in the transportation direction with the nip point therebetween.

If the difference of the distance in the transportation direction from the nip point to the first print head and the distance from the nip point to the second print head differ greatly, the platen gap on the first print head side and the platen gap on the second print head side will differ greatly relative to the opening created between the first and second media transportation rollers by the thickness of the recording medium. The difference in the platen gaps to the recording medium thickness can be reduced by disposing the first and second print heads upstream and downstream from the nip point in the transportation direction.

Further preferably in a printer according to another aspect of the invention, the first print head and second print head are dot impact heads, and the first print head unit and second print head unit each have an ink ribbon cassette loading unit.

Because the second print head unit can move and the gap between the first print head and the first platen, and the gap between the second print head and the second platen, increase when the second print head unit is forcibly moved in the direction away from the first print head unit side, the ink ribbon can be easily set in these gaps.

EFFECT OF THE INVENTION

In a printer according to the invention, a second media transportation roller disposed to a movable second print head unit is pressed against a first media transportation roller on the first print head unit side, thereby determining the relative positions therebetween. By maintaining contact between the first and second media transportation rollers by means of an urging member, the platen gaps of the first print head and second print head can be held constant, and resistance to external disturbance of the platen gaps can be improved. In addition, because the gap between the first and second media transportation rollers changes according to the thickness of the conveyed recording medium, and the platen gaps of the first and second print heads change, the platen gap increases according to the thickness of the conveyed recording medium, and the distance between the print head units and recording medium can be held to a constant gap or greater.

Other objects and attainments together with a fuller understanding of the invention will become apparent and appreciated by referring to the following description and claims taken in conjunction with the accompanying drawings.

DESCRIPTION OF EMBODIMENTS

A check processing device (e.g., a printer) according to a preferred embodiment of the present invention is described below with reference to the accompanying figures.

General Configuration

Figure 1:
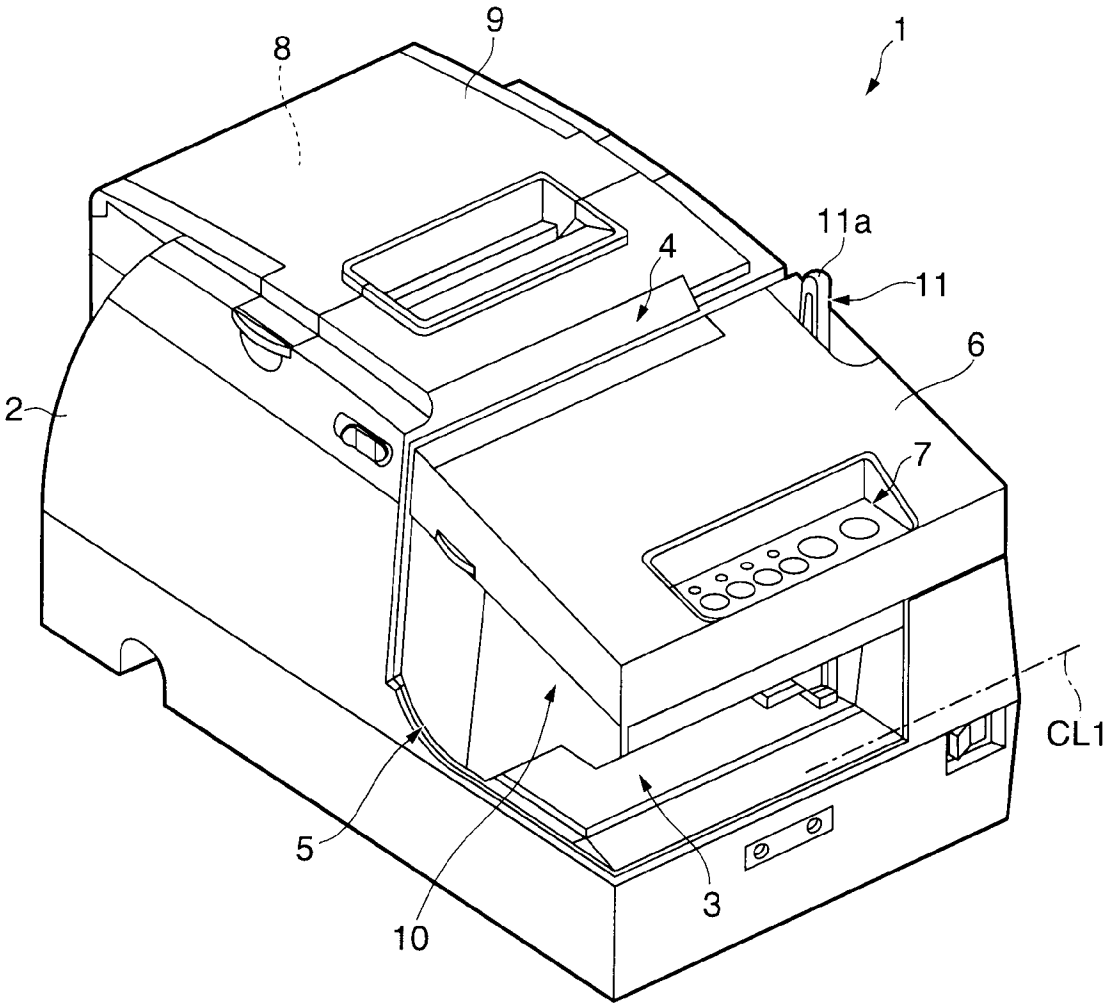
FIG. 1 is an external oblique view of a check processing device according to a preferred embodiment of the invention.

FIG. 1 is an external oblique view of a check processing device. The check processing device 1 has a basically rectangular box-like outside case 2. A media insertion opening 3 for inserting a recording medium such as a check (not shown in the figure) is disposed with a specific width widthwise to the printer on the front left side of the outside case 2.

A media exit 4 from which the processed checks are discharged is disposed with a specific width widthwise to the printer in the top of the outside case 2 in the middle between the front and back of the printer.

A media transportation path 5 through which the checks are conveyed is formed between the media insertion opening 3 and the media exit 4. The media transportation path 5 extends from the media insertion opening 3 toward the back of the printer and then curves and extends to the top. The media transportation path 5 is also open to the left side of the outside case 2.

The top of the outside case 2 in front of the media exit 4 is covered by a front cover 6. An operating panel 7 is disposed at the front of the front cover 6. A compartment 8 is disposed and a cover 9 for opening and closing the compartment 8 is attached at the back of the top of the outside case 2. The cover 9 is pivotably attached at the back end thereof to the outside case 2.

The part of the check processing device 1 covered by the front cover 6 is an openable unit 10, which can open forward pivoting on a first pivot axis CL1 that extends widthwise to the printer at the front bottom part of the openable unit 10. Opening the openable unit 10 opens the media transportation path 5 rendered between the openable unit 10 and the printer assembly. The openable unit 10 can be opened by manually pulling an operating lever 11 of which the operating end 11*a* is exposed at the top right part of the openable unit 10 forward.

Internal Configuration

Figure 2:
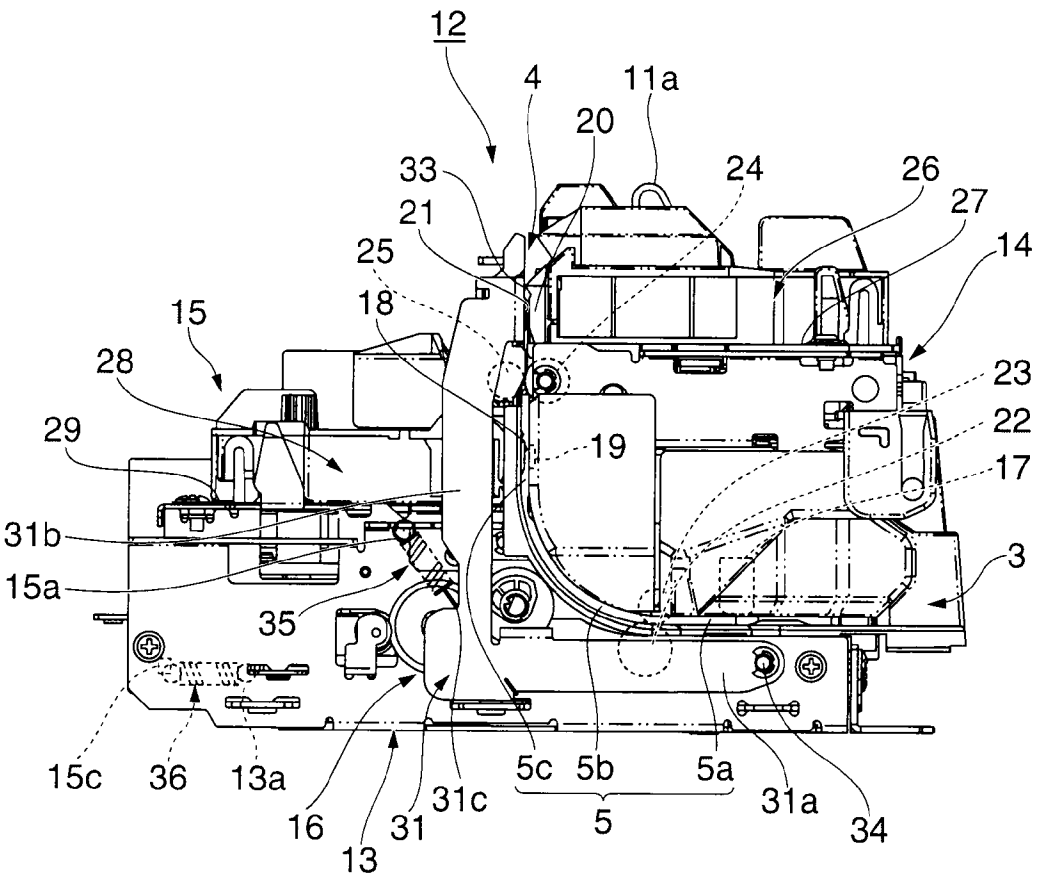
FIG. 2 is a side view showing the internal mechanical assembly of the check processing device.
Figure 3:
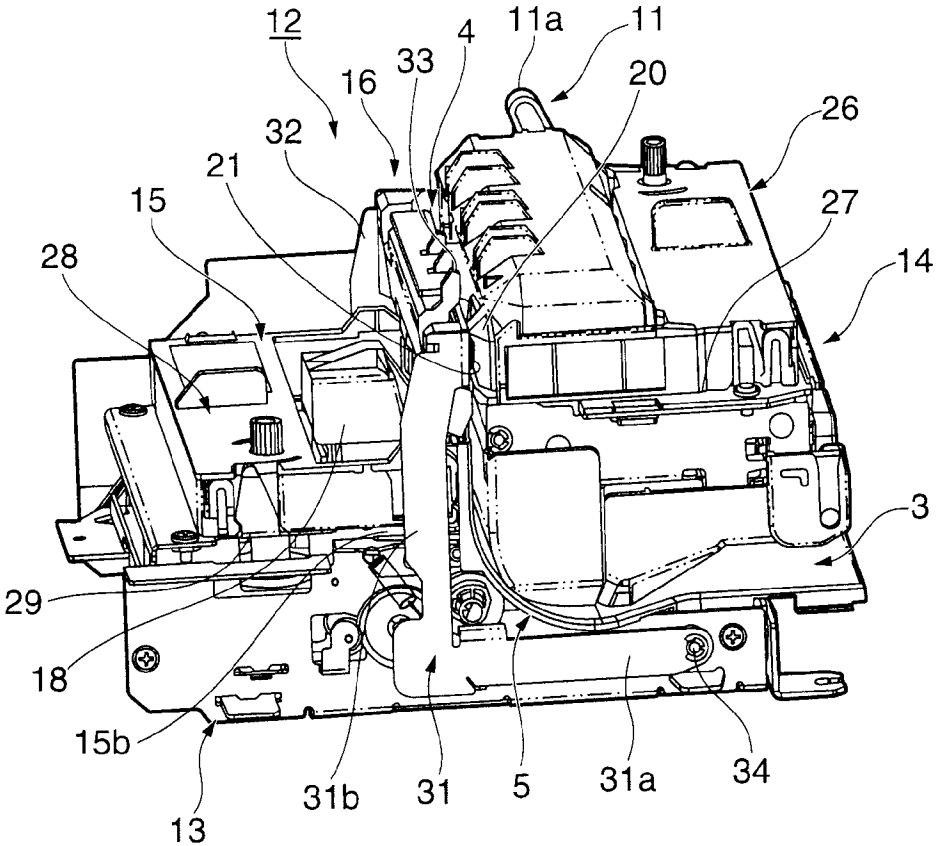
FIG. 3 is an oblique view of the internal mechanical assembly of the check processing device.
Figure 4:
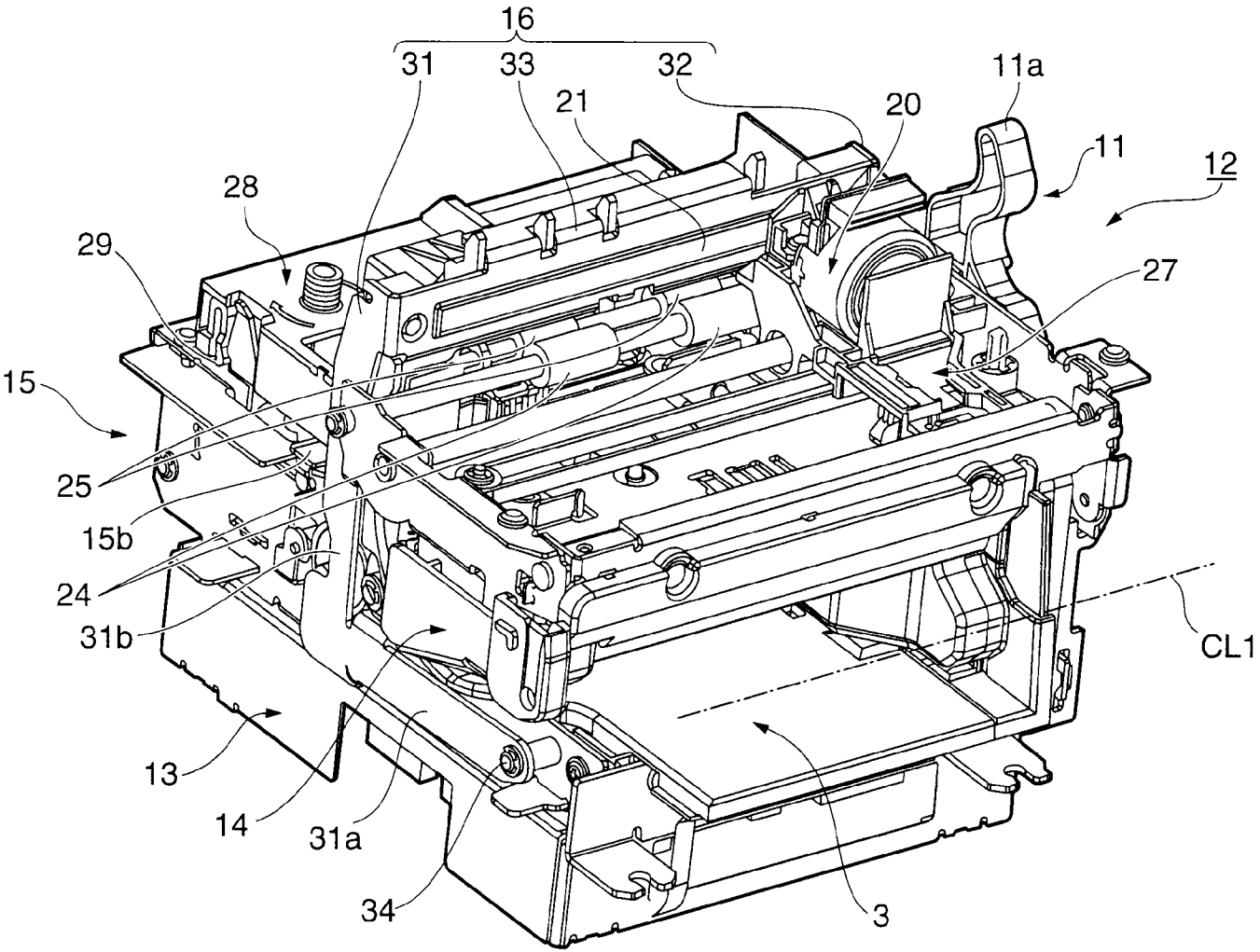
FIG. 4 is an oblique view of the internal mechanical assembly of the check processing device.

FIG. 2 is a side view showing the internal mechanical assembly of the check processing device 1 with the outside case 2 removed. FIG. 3 is an oblique side view of the internal mechanical assembly from a point of view slightly towards the back, and FIG. 4 is an oblique side view of the internal mechanical assembly from a position at the front.

As shown in these figures, the internal mechanical assembly 12 of the check processing device 1 includes a main frame 13, and a front print head unit 14 composing the openable unit 10, back print head unit 15, and platen lever unit 16 supported on the main frame 13.

The front print head unit 14 and back print head unit 15 are disposed in opposition with the vertical transportation path portion 5*c* where the media transportation path 5 extends to the top of the printer therebetween and the front print head unit 14 positioned on the side towards the front of the printer. The front print head unit 14 and main frame 13 are disposed in opposition with the horizontal transportation path part 5*a* that extends straight from the front toward the back of the printer, and the curved transportation path part 5*b* that curves upward to the vertical transportation path part 5*c*, therebetween, and the front print head unit 14 positioned on the side to the top of the printer.

The front print head unit 14 is supported on the main frame 13 so that the front print head unit 14 can pivot forward and open on the first pivot axis CL1 at the front bottom end thereof. The back print head unit 15 is supported on the main frame 13 so that the back print head unit 15 can slide in the front-back direction of the printer.

A magnetic head 17 used to read the magnetic ink characters that are printed on checks is disposed to the horizontal transportation path part 5*a* of the media transportation path 5. The magnetic head 17 is disposed on the top side of the horizontal transportation path part 5*a* with the magnetic gap facing down.

The back print head 18 and opposing back platen 19 for printing on the back side of checks are disposed at the bottom side of the vertical transportation path part 5*c* of the media transportation path 5 with the vertical transportation path part 5*c* therebetween. The back print head 18 is a serial impact dot matrix (SIDM) print head that prints by driving recording wires against an ink ribbon to transfer ink from the ink ribbon onto the check. The back print head 18 is disposed to the back print head unit 15 located on the back side of the vertical transportation path part 5*c*, and the back platen 19 is disposed to the front print head unit 14.

The front print head 20 and opposing front platen 21 for printing on the front side of checks are disposed to the top part of the vertical transportation path part 5*c* with the vertical transportation path part 5*c* therebetween. Like the back print head 18, the front print head 20 is also an SIDM print head, and is disposed to the front print head unit 14. The front platen 21 is disposed to the platen lever unit 16.

A pair of media transportation rollers 22, 23 that convey checks passed the reading position of the magnetic head 17 are disposed in contact with each other where the horizontal transportation path part 5*a* and curved transportation path part 5*b* join. A pair of first and second media transportation rollers 24, 25 that convey checks are disposed in contact with each other at a position approximately centered between the back print head 18 and the front print head 20 on the vertical transportation path part 5*c*. The first media transportation roller 24 is positioned on the side to the front of the printer and is disposed freely rotatably to the front print head unit 14. The second media transportation roller 25 is positioned on the side to the back of the printer, and is disposed freely rotatably to the platen lever unit 16.

An ink ribbon cassette loading unit 27 to which an ink ribbon cassette 26 storing an ink ribbon can be removably installed is disposed to the front print head unit 14. Note that the ink ribbon cassette 26 is not shown in FIG. 4. The ink ribbon (not shown in the figure) delivered from the loaded ink ribbon cassette 26 is set passing between the front print head 20 and front platen 21.

An ink ribbon cassette loading unit 29 to which an ink ribbon cassette 28 can be removably installed is similarly disposed to the back print head unit 15. The ink ribbon (not shown in the figure) delivered from this ink ribbon cassette 28 is set passing between the back print head 18 and back platen 19.

The platen lever unit 16 includes left and right platen levers 31 and 32 disposed on opposite sides of the printer width, and a connecting plate 33 that spans between the tops of these platen levers 31, 32 widthwise to the printer. The connecting plate 33 has a constant width and is disposed facing the front of the printer. The front platen 21 is attached to the surface of the connecting plate 33 facing the front of the printer opposite the printing surface of the front print head 20.

The left and right platen levers 31, 32 are identically shaped and disposed symmetrically left and right. Using platen lever 31 by way of example, each platen lever 31, 32 is L-shaped with a horizontal arm 31*a* of a constant width extending straight in the front-back direction of the printer, and a vertical arm 31*b* of a constant width that bends substantially perpendicularly from the back end of the horizontal arm 31*a* and extends straight up.

The horizontal arms 31*a* are disposed on the opposite sides of the main frame 13 widthwise to the printer below the front print head unit 14, and the ends thereof at the front of the printer are attached to the main frame 13 so that the horizontal arms 31*a* can pivot up and down on a pivot shaft 34 extending widthwise to the printer.

The vertical arms 31*b* are disposed on opposite sides of the back print head unit 15 widthwise to the printer at positions behind the vertical transportation path part 5*c* of the media transportation path 5.

The second media transportation roller 25 extends widthwise to the printer between the vertical arms 31*b* at a position below the connecting plate 33.

The other platen lever 32 is identically configured and further description thereof is thus omitted.

A lever tension spring 35 is mounted between the left and right platen levers 31, 32 and the back print head unit 15. Referring to FIG. 2 and using platen lever 31 byway of example, the lever tension spring 35 spans between a spring catch 31*c* formed on the bottom end of the vertical arm 31*b*, and a spring catch 15*a* formed at a position on the back print head unit 15 above and behind the spring catch 31*c*. The platen lever unit 16 is pulled in a direction pivoting upward on the pivot shaft 34 by the spring force of the lever tension spring 35, causing the second media transportation roller 25 mounted thereon to contact the first media transportation roller 24 on the front side of the printer with specific pressure.

Another tension spring is identically disposed on the side of the other platen lever 32.

A stop 15*b* that protrudes to the outside is formed on the left side of the back print head unit 15. The stop 15*b* and the back edge 31*d* of the vertical arm 31*b* of the platen lever 31 are held in contact with each other by the spring force of the lever tension spring 35.

The platen lever 32 on the other side is configured the same way.

The back print head unit 15 is pulled toward the front of the printer by unit tension springs 36, which are disposed applying tension in the front-back direction of the printer on opposite sides of the printer width. As shown in FIG. 2, the ends of the unit tension springs 36 at the back of the printer are held on spring catches 15*c* formed on the left and right sides of the back print head unit 15, and the ends at the front side of the printer are held on spring catches 13*a* formed on the left and right sides of the main frame 13. The back print head unit 15 is thus pushed to the platen lever unit 16 through the intervening left and right stops 15*b* by the spring force of these unit tension springs 36.

Platen Gap Adjustment Mechanism

Figure 5:
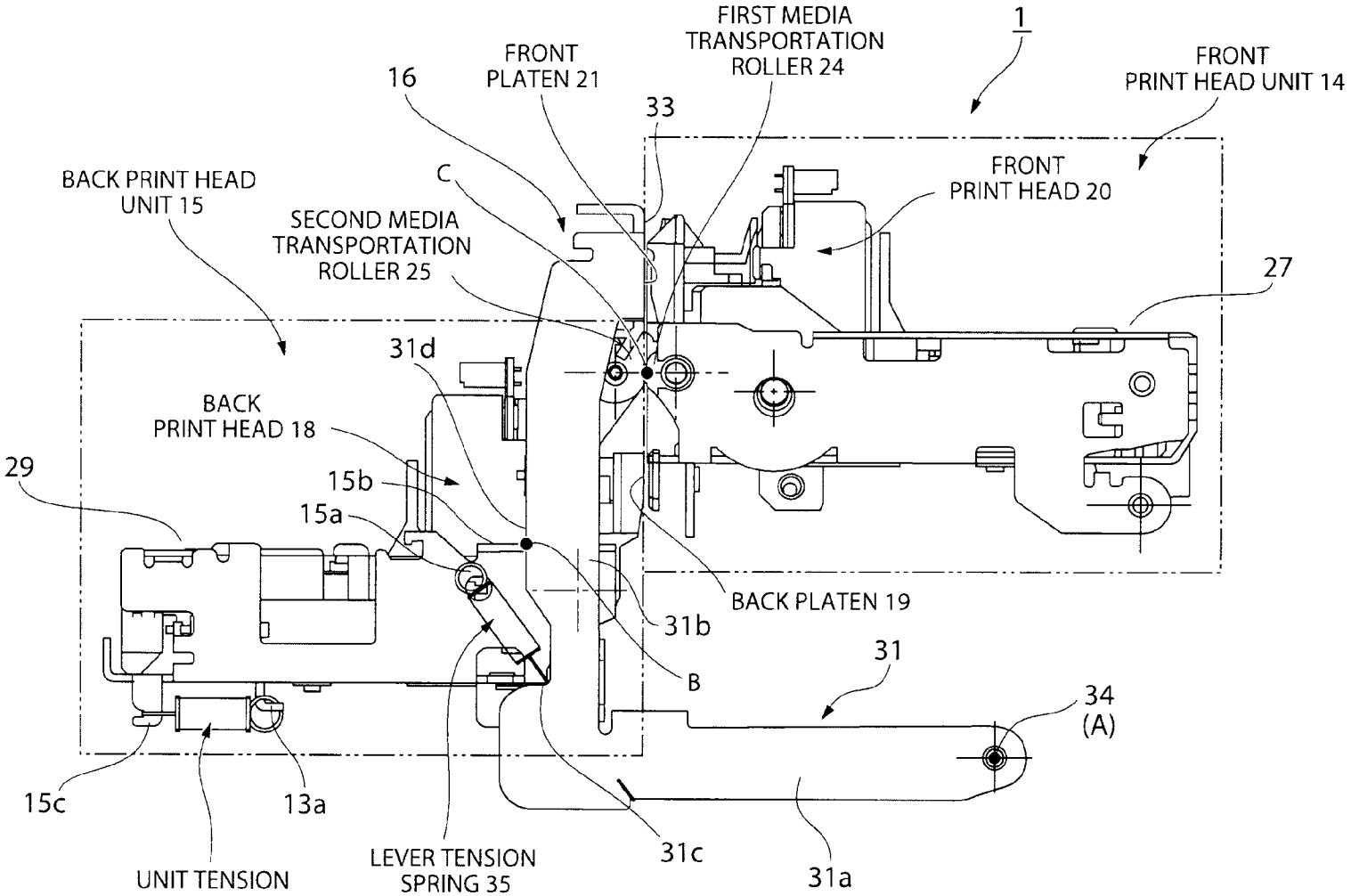
FIG. 5 describes the platen gap adjustment mechanism of the check processing device.

FIG. 5 describes the parts associated with the platen gap adjustment mechanism of the check processing device 1. The platen gap adjustment mechanism of the front print head 20 and back print head 18 is described below referring particularly to FIG. 5.

In this embodiment of the invention the second media transportation roller 25 mounted on the platen lever unit 16 is pushed to the first media transportation roller 24 mounted on the front print head unit 14 by the lever tension spring 35 at nip point C. Contact between the first media transportation roller 24 and second media transportation roller 25 thus determines the position of the back print head unit 15 relative to the platen lever unit 16, the position of the front print head 20 on the front print head unit 14 relative to the front platen 21 on the platen lever unit 16, and thus determines the platen gap of the front print head 20.

The back print head unit 15 is pressed by the unit tension spring 36 at point B against the platen lever unit 16, which is positioned to the front print head unit 14, and the relative positions thereof are determined by this contact between the platen lever unit 16 and back print head unit 15. As a result, the position of the back print head unit 15 relative to the front print head unit 14, the position of the back print head 18 on the back print head unit 15 relative to the back platen 19 on the front print head unit 14, and the platen gap of the back print head 18 are determined by means of the intervening platen lever unit 16.

The platen gap on the front print head 20 side is thus adjusted between the front print head unit 14 and platen lever unit 16, and the platen gap on the back print head 18 side is adjusted between the front print head unit 14 and back print head unit 15. The gap between the front print head unit 14 and back print head unit 15 can therefore be easily adjusted compared with adjusting both platen gaps.

When the front print head unit 14, platen lever unit 16, or back print head unit 15 is displaced by an external force, the other two units are also displaced accordingly. For example, when the front print head unit 14 is displaced, the platen lever unit 16 moves following the front print head unit 14, and the back print head unit 15 moves following the displacement of the platen lever unit 16. Because the relative positions of these three units therefore remain constant, the platen gap between the front print head 20 and front platen 21, and the platen gap between the back print head 18 and back platen 19, also remain constant, and resistance to external disruption of the platen gap can be improved.

The positions of the front print head unit 14 and platen lever unit 16 relative to the other are also determined by contact between the first media transportation roller 24 and second media transportation roller 25. The gap between these rollers 24, 25 changes according to the thickness of the conveyed check (recording medium). As a result, the position of the platen lever unit 16 relative to the front print head unit 14 determined by contact between these rollers 24, 25 thus changes, and the position of the back print head unit 15 determined by the platen lever unit 16 also changes. As a result, the gap between the front print head 20 on the front print head unit 14 side and the front platen 21 on the platen lever unit 16 side, and the gap between the back print head 18 on the back print head unit 15 side and the back platen 19 on the front print head unit 14 side, change according to the thickness of the conveyed check. The platen gaps of both print heads 18 and 20 therefore change according to the thickness of the conveyed check, and the distance between the head units and the recording medium can be held to a specific value or more.

In addition, a pivot member that can rotate on a pivot point A is used as the platen lever unit 16, and the platen lever unit 16 and back print head unit 15 are pushed together by the spring force of the lever tension spring 35. Because this configuration can therefore suppress play between the platen lever unit 16 and back print head unit 15, it is also effective for holding a constant platen gap.

Next, when seen along the transportation direction of a check passing the nip point C of the first media transportation roller 24 and second media transportation roller 25, the nip point C is positioned substantially centered between the front print head 20 and back print head 18 on opposite sides of the nip point C. If the distance in the transportation direction from the nip point C to the front print head 20 differs greatly from the distance from the nip point C to the back print head 18, the platen gap on the front print head 20 side and the platen gap on the back print head 18 side will differ greatly from the opening between the first and second transportation rollers 24, that is created by the thickness of the check. However, by disposing the front print head 20 and back print head 18 proximally to the downstream and upstream sides of the nip point C in the transportation direction, the difference in the change between both platen gaps caused by the thickness of the check can be reduced.

In addition, the front print head 20 and back print head 18 in this embodiment of the invention are dot impact heads, and ink ribbons must be respectively set between the front print head 20 and front platen 21 and between the back print head 18 and back platen 19. Because the back print head 18 can slide in the direction between the front and back of the printer, the gap between the front print head 20 and front platen 21 and the gap between the back print head 18 and back platen 19 can be increased by sliding the back print head 18 toward the back against the force of the spring, and the ink ribbons can therefore be easily set in these gaps.

Other Embodiments

The embodiment described above uses a platen lever unit to position the back print head unit relative to the front print head unit. A configuration rendering the platen lever unit and back print head unit in unison is also conceivable.

In a printer thus configured, the front print head, first media transportation roller, and back platen are mounted on the front print head unit. In addition, the f rant platen is mounted at a position opposite the front print head on the back print head unit, the second media transportation roller is mounted at a position where it can contact the first media transportation roller, and the back print head unit is supported on the main frame so that it can move toward and away from the first media transportation roller. In addition, the back print head unit is urged toward the first media transportation roller, and the second media transportation roller is pressed against the first media transportation roller, by a tension spring or other urging member.

In a printer thus comprised, the back print head unit can move, the second media transportation roller mounted on the back print head unit is pushed against the first media transportation roller mounted on the stationary front print head unit by an urging member, and the relative positions of both units are determined by the first and second media transportation rollers. When both units are displaced by an external force, for example, the back print head unit side moves according to this displacement, contact between the first media transportation roller and second media transportation roller is sustained by the urging force of the urging member, the relative positions of both units are held constant, and resistance to external disturbance of the platen gaps of the front and back print heads is therefore improved.

The relative positions of the front print head unit and back print head unit are also determined by contact between the first media transportation roller and second media transportation roller. The gap between these rollers changes according to the thickness of the conveyed recording medium. The relative position of the front print head unit to the back print head unit that is determined by contact between these rollers therefore also changes. As a result, the gap between the front print head on the front print head unit side and the front platen on the back print head unit side, and the gap between the back print head on the back print head unit side and the back platen on the front print head unit side, change according to the thickness of the conveyed recording medium. The platen gaps of both print heads can therefore change according to the thickness of the conveyed recording medium.

An L-shaped arm unit is used as the platen lever unit in the foregoing embodiment, but arm units with different shapes can be used instead. A platen lever unit that slides in the front-back direction of the printer instead of pivoting could also be used.

The front and back print heads are serial impact dot matrix print heads in the foregoing embodiment, but inkjet heads can be used instead.

The embodiment described above applies the invention to a check processing device, but the invention can be similarly applied to printers that print on recording media other than checks.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer, comprising:

a first print head unit on which a first print head, a first media transportation roller, and a second platen are disposed;

a second print head unit configured to move linearly in a direction toward and away from the first media transportation roller, and on which are disposed a first platen at a position opposing the first print head, a second media transportation roller at a position where it can contact the first media transportation roller, and a second print head at a position opposing the second platen; and an urging member that urges the second print head unit linearly toward the first media transportation roller and presses the second media transportation roller to the first media transportation roller.

2. A printer, comprising:

a first print head unit on which a first print head, a first media transportation roller, and a second platen are disposed;

a moving member configured to move in a direction toward and away from the first media transportation roller, and on which are disposed a second media transportation roller at a position where it can contact the first media transportation roller, and a first platen at a position opposing the first print head;

a first urging member that urges the moving member toward the first media transportation roller and presses the second media transportation roller to the first media transportation roller;

a second print head unit configured to move in a direction toward and away from the first media transportation roller, and on which a second print head is disposed at a position opposing the second platen; and a second urging member that urges the second print head unit toward the first media transportation roller and presses the second print head unit to the moving member.

3. The printer described in claim 2, wherein:

the moving member comprises a pivot member configured to rotate on a pivot point; and the first urging member comprises a tension spring connected between the pivot member and the second print head unit.

4. The printer described in claim 2, wherein:

as seen along a transportation direction of a recording medium passing a nip point of the first media transportation roller and second media transportation roller, one of the first print head and second print head is positioned on the upstream side with respect to the transportation direction and the other is positioned on the downstream side with respect to the transportation direction with the nip point between the first and second print heads.

5. The printer described in claim 2, wherein:

each of the first print head and second print head is a dot impact print head; and each of the first print head unit and second print head unit further comprises an ink ribbon cassette loading unit.

6. The printer described in claim 2, wherein the first print head unit, the second print head unit, and the moving member are arranged such that the relative position of each with respect to the other two remains substantially constant during operation.

* * * * *